US011333450B2

(12) United States Patent
Bonnafous

(10) Patent No.: US 11,333,450 B2
(45) Date of Patent: May 17, 2022

(54) PLATE FOR HEAT EXCHANGER AND HEAT EXCHANGER INCLUDING THE PLATE

(71) Applicant: Nexson Group, Garchizy (FR)

(72) Inventor: Charles Bonnafous, Varenne-Vauzelles (FR)

(73) Assignee: Nexson Group

( * ) Notice: Subject to any disclaimer, the term of this patent is extended or adjusted under 35 U.S.C. 154(b) by 0 days.

(21) Appl. No.: 17/257,692

(22) PCT Filed: Jul. 5, 2019

(86) PCT No.: PCT/EP2019/068157
§ 371 (c)(1),
(2) Date: Jan. 4, 2021

(87) PCT Pub. No.: WO2020/008055
PCT Pub. Date: Jan. 9, 2020

(65) Prior Publication Data
US 2021/0156628 A1 May 27, 2021

(30) Foreign Application Priority Data
Jul. 5, 2018 (FR) ..... 1856214

(51) Int. Cl.
*F28F 9/00* (2006.01)
*F28D 9/00* (2006.01)
(Continued)

(52) U.S. Cl.
CPC ..... *F28F 9/001* (2013.01); *F28D 9/0037* (2013.01); *F28D 9/0062* (2013.01); *F28F 3/046* (2013.01);
(Continued)

(58) Field of Classification Search
CPC ..... F28F 9/001; F28F 9/0212; F28F 3/046; F28F 3/048; F28F 3/036; F28F 2250/10;
(Continued)

(56) References Cited

U.S. PATENT DOCUMENTS 1,962,954 A * 6/1934 Gofferje ..... F28D 1/0383 165/170
3,181,602 A * 5/1965 Johnstone ..... F28D 19/044 165/4
(Continued)

FOREIGN PATENT DOCUMENTS

CN 107024124 A 8/2017
CN 108120327 A 6/2018
(Continued)

OTHER PUBLICATIONS

International Search Report for PCT/P2019/068157 dated Oct. 4, 2019; 2 pages.

*Primary Examiner* — Tho V Duong
(74) *Attorney, Agent, or Firm* — Lerner, David, Littenberg, Krumholz & Mentlik, LLP

(57) ABSTRACT

A plate for a heat exchanger, intended to be arranged in a stack of plates, includes: —a main panel having a first edge and a second edge, opposite the first edge, and at least one first fin protruding from the main panel and capable of delimiting, with the main panel and an adjacent plate, a fluid flow path, wherein the first fin extends from the first edge of the main panel towards the second edge, without extending up to the second edge, so as to provide a first fluid passage between one end of the first fin and the second transverse edge where the fluid flow path forms a first baffle.

12 Claims, 9 Drawing Sheets

Figure 2:
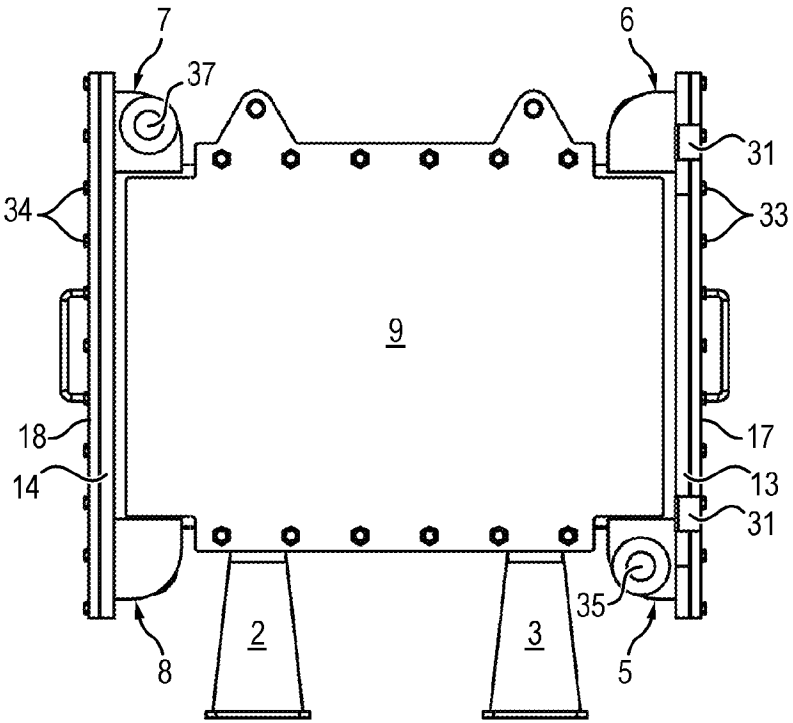

(51) Int. Cl.
*F28F 3/04* (2006.01)
*F28F 3/06* (2006.01)
*F28F 9/02* (2006.01)

(52) U.S. Cl.
CPC ..... *F28F 3/048* (2013.01); *F28F 3/06* (2013.01); *F28F 9/0212* (2013.01); *F28F 2275/04* (2013.01); *F28F 2275/205* (2013.01)

(58) Field of Classification Search
CPC F28F 2280/105; F28D 9/0037; F28D 9/0068; F28D 9/0062; F28D 1/0308; F28D 1/035; F28D 9/0006; F28D 9/0031
USPC ..... 165/177
See application file for complete search history.

(56) References Cited

U.S. PATENT DOCUMENTS

| | | | | |
|---|---|---|---|---|
| 6,190,624 | B1 * | 2/2001 | Romatier | B01J 8/002 422/200 |
| 6,729,389 | B2 * | 5/2004 | Ohashi | F28D 1/0383 165/168 |
| 2004/0069474 | A1 * | 4/2004 | Wu | F28D 1/035 165/170 |

FOREIGN PATENT DOCUMENTS

| | | | | |
|---|---|---|---|---|
| FR | 694608 | A * | 12/1930 | F28F 3/12 |
| GB | 1494891 | A * | 12/1977 | F28F 9/0075 |
| GB | 2251061 | A | 6/1992 | |
| WO | 8503767 | A1 | 8/1985 | |
| WO | WO-2011022738 | A1 * | 3/2011 | F28D 1/0383 |

* cited by examiner

PLATE FOR HEAT EXCHANGER AND HEAT EXCHANGER INCLUDING THE PLATE

CROSS-REFERENCE TO RELATED APPLICATIONS

The present application is a national phase entry under 35 U.S.C. § 371 of International Application No. PCT/EP2019/068157, filed Jul. 5, 2019, which claims priority from French Patent Application No. 1856214 filed Jul. 5, 2018, all of which are incorporated herein by reference.

FIELD OF THE INVENTION

The invention relates to a plate for a heat exchanger, and a heat exchanger including such a plate.

PRIOR ART

Heat exchangers have the function of implementing an exchange of heat between several fluids, without however mixing them.

Heat exchangers called "welded plate heat exchangers" are currently used in industry, because they have good thermal performance due to their large exchange surface, while still being compact.

These heat exchangers generally comprise a stack (or pack) of superimposed plates, defining between them two separate fluid circulation circuits, and a frame forming an enclosure intended to house the plate pack.

These exchangers also comprise collectors attached to the frame. These collectors are connected to ducts allowing fluids to be brought to the exchanger and to ducts allowing fluids to be removed from the exchanger once they have circulated in the exchanger.

In these exchangers, a hot fluid and a cold fluid circulate respectively in the two circulation circuits formed between the plates, in two orthogonal directions.

These exchangers can be used to process fluids of different types, which may sometimes contain solid particles. These exchangers therefore necessitate being regularly cleaned in order to avoid fouling and to guarantee good operating performance.

However, the cleaning of welded plate heat exchangers can constitute a long and complex operation. In fact, this operation necessitates either disassembling the collectors attached to the frame in order to be able to gain access to the plate pack to proceed with mechanical cleaning, or circulating a chemical cleaning agent in the heat exchanger, such as a detergent or a disinfectant.

The cleaning of a heat exchanger further necessitates stoppage of the factory.

SUMMARY OF THE INVENTION

One aim of the invention is to propose a solution guaranteeing high effectiveness of the heat exchanger, while still facilitating its cleaning.

This aim is achieved within the scope of the present invention, thanks to a plate for a heat exchanger, intended to be disposed in a plate stack, the plate comprising:

- a main panel having a first edge, a second edge opposite to the first edge, a third edge and a fourth edge opposite to the third edge,
- at least one first longitudinal rib protruding from the main panel and able to delimit, with the main panel and an adjacent plate, a fluid circulation path, and

- a first junction panel extending from the third longitudinal edge, wherein the first rib extends from the first edge of the main panel toward the second edge, without extending until the second edge, so as to provide a first fluid passage between one end of the first rib and the second edge where the fluid circulation path forms a first baffle and wherein the first junction panel has a fluid inlet opening allowing entry of the fluid to the circulation path.

With a plate of this type, it is possible to create a welded plate heat exchanger in which the circulation path of one of the fluids along the same plate forms one or more baffle(s). The baffle(s) increase(s) turbulence in the fluid and cause(s) changes of speed, thereby reducing the fouling of the heat exchanger.

In addition, the plate can be designed so that the cleaning of the exchanger can be performed by gaining access to the plate pack by one of the faces of the plate pack extending transversely to the longitudinal ribs of the plates. Due to the orientation of the rib, access to this face of the plate pack allows cleaning the entire fluid circulation channel. The heat exchanger can further be designed so that no collector is attached to this face of the plate pack. Thus, it is not necessary to disassemble the collector to proceed with mechanical cleaning of the exchanger.

The plate can advantageously have one of the following features:

- the plate comprises at least one second rib protruding from the main panel, parallel to the first rib, extending from the second edge of the main panel toward the first edge, without extending until the first edge, so as to provide a fluid passage between one end of the second rib and the first edge where the fluid circulation path forms a second baffle;
- the plate comprises a plurality of first ribs and a plurality of second ribs disposed alternately with the first ribs;
- the plate comprises a second junction panel extending from the third edge, the second junction panel having a fluid outlet opening allowing fluid originating in the circulation path to exit;
- the plate is devoid of a rib parallel to the first edge delimiting the fluid circulation path.

The invention further relates to a heat exchanger comprising:

- a plate pack comprising a stack of plates welded together, each plate being as previously defined, the plate pack comprising a first lateral face defined by first and second edges of the plates of the stack, and a second lateral face defined by the first and second opposite edges of the plates of the stack, and
- a first door movable in rotation relative to the plate pack, between a closed position in which the first door covers the first lateral face of the stack, and an open position in which the first door does not cover the first lateral face of the stack and allows access to spaces defined between the plates.

The proposed heat exchanger can advantageously have one of the following features:

- the heat exchanger further comprises a first fluid inlet collector and a first fluid outlet collector, each of the first collectors being attached to a face of the stack orthogonal to the lateral faces and defined by third and fourth edges of the plates of the stack;
- each first collector comprises a first collector wall extending from the face of the stack orthogonal to the lateral faces until the first door, so that when the first door is in the open position, the first door allows access to an internal space of the first collector;

the heat exchanger further comprises a first gasket able to be disposed against the first lateral face of the stack, in contact with each of the first and second edges forming the first lateral face;

the heat exchanger further comprises a second door movable in rotation relative to the plate pack, between a closed position in which the second door covers the second lateral face of the stack, and an open position in which the second door does not cover the second lateral face of the stack and allow access to spaces defined between the plates;

the heat exchanger further comprises a second fluid inlet collector and a second fluid outlet collector, each of the second collectors being attached to a face of the stack orthogonal to the lateral faces and defined by the third and fourth edges of the plates of the stack;

each second collector comprises a second collector wall extending from the face of the stack orthogonal to the lateral faces until the second door, so that when the second door is in the open position, the second door allows access to an internal space of the second collector;

the heat exchanger comprises a second gasket able to be disposed against the second lateral face, in contact with each of the first and second edges forming the second lateral face.

PRESENTATION OF THE DRAWINGS

Figure 1:
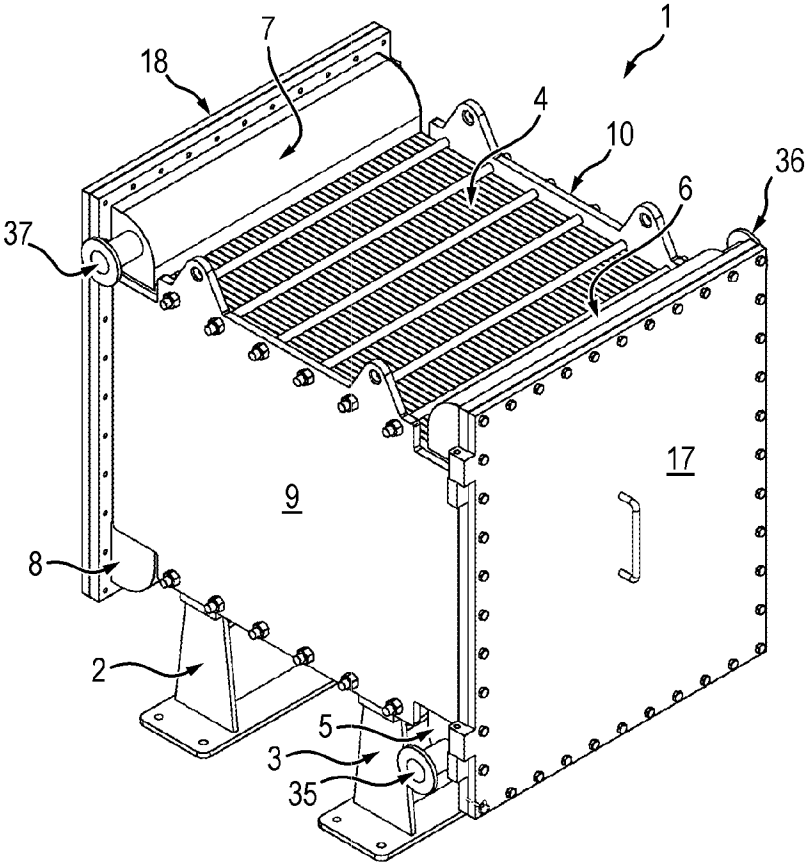
Figure 4:
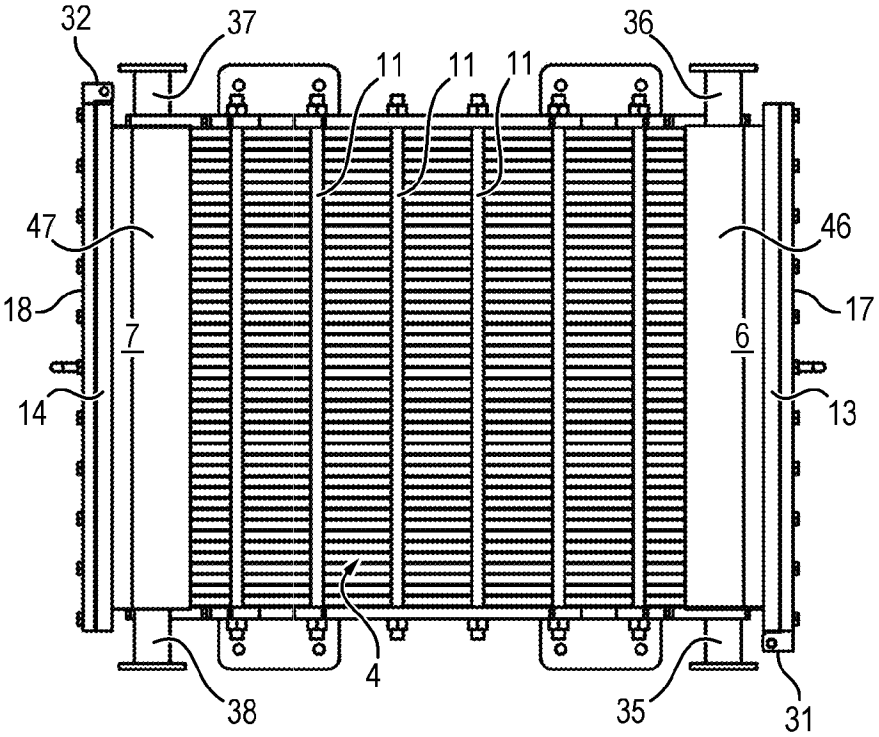
Figure 3:
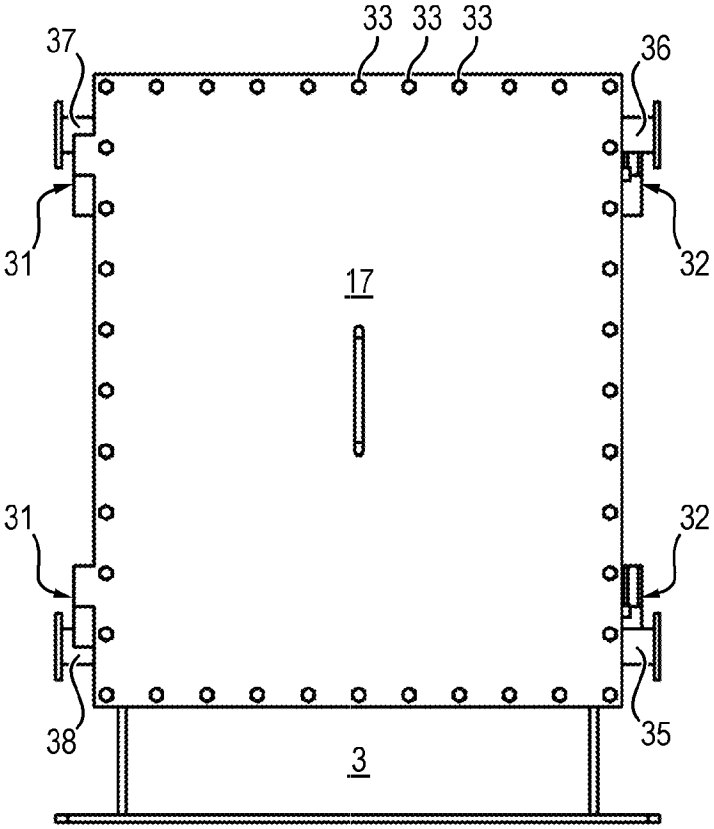
Figure 6:
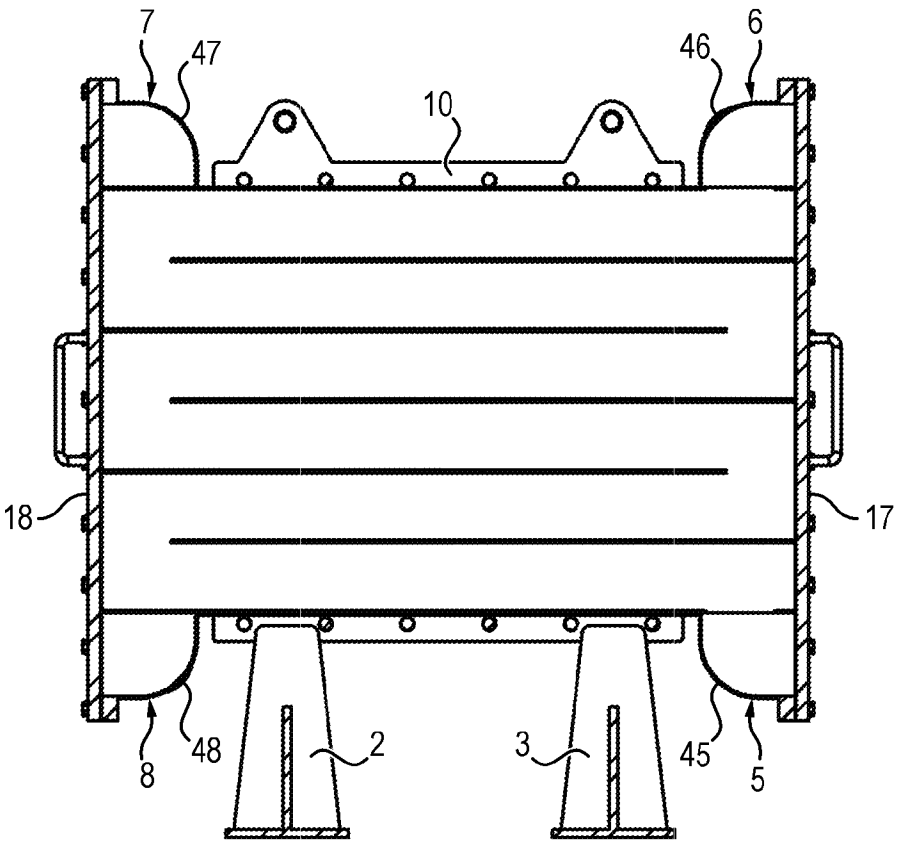
Figure 5:
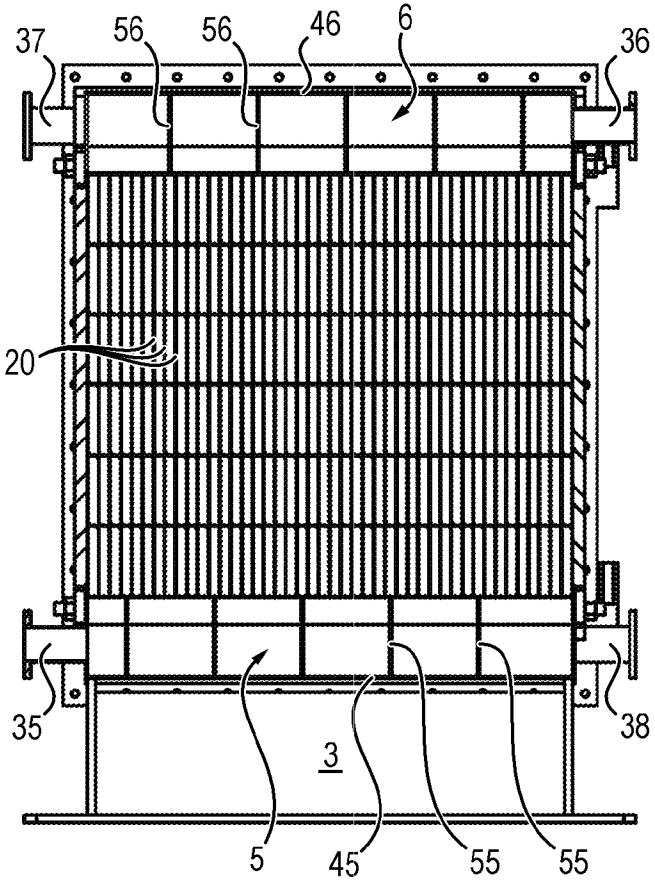
Figure 7:
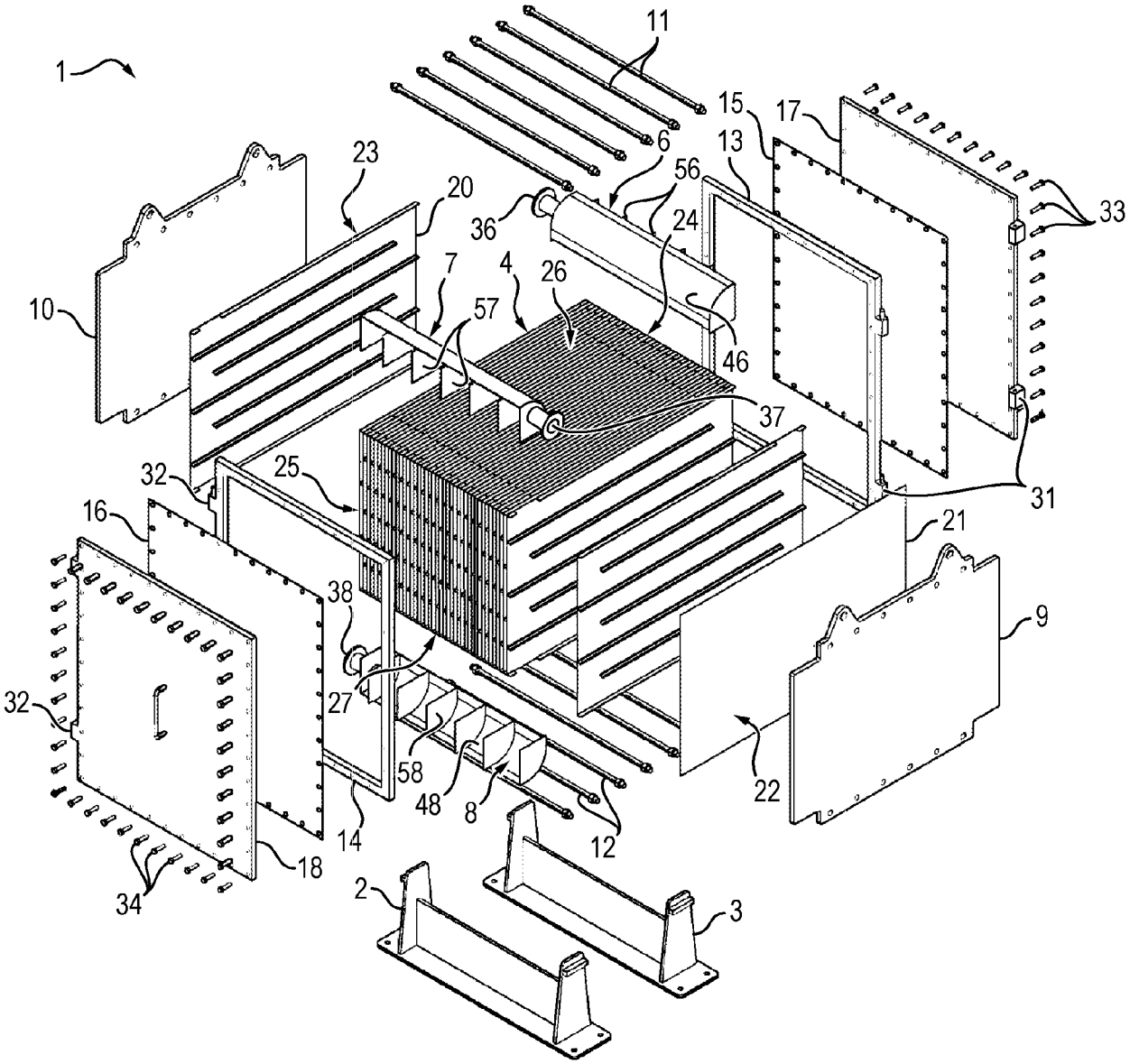
Figure 8A:
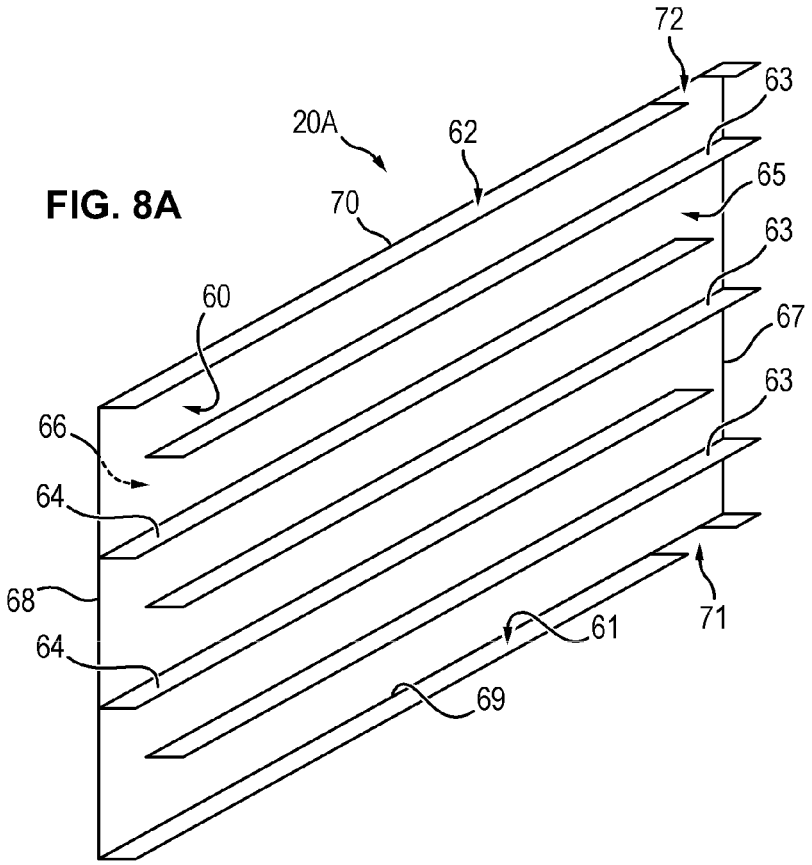
Figure 8B:
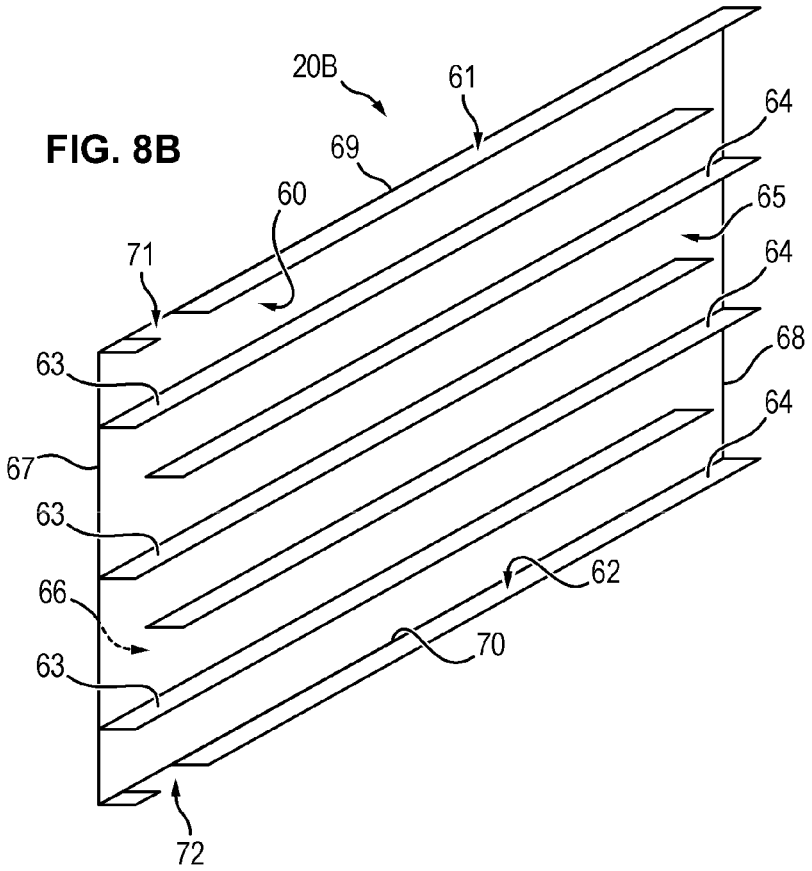
Figure 9:
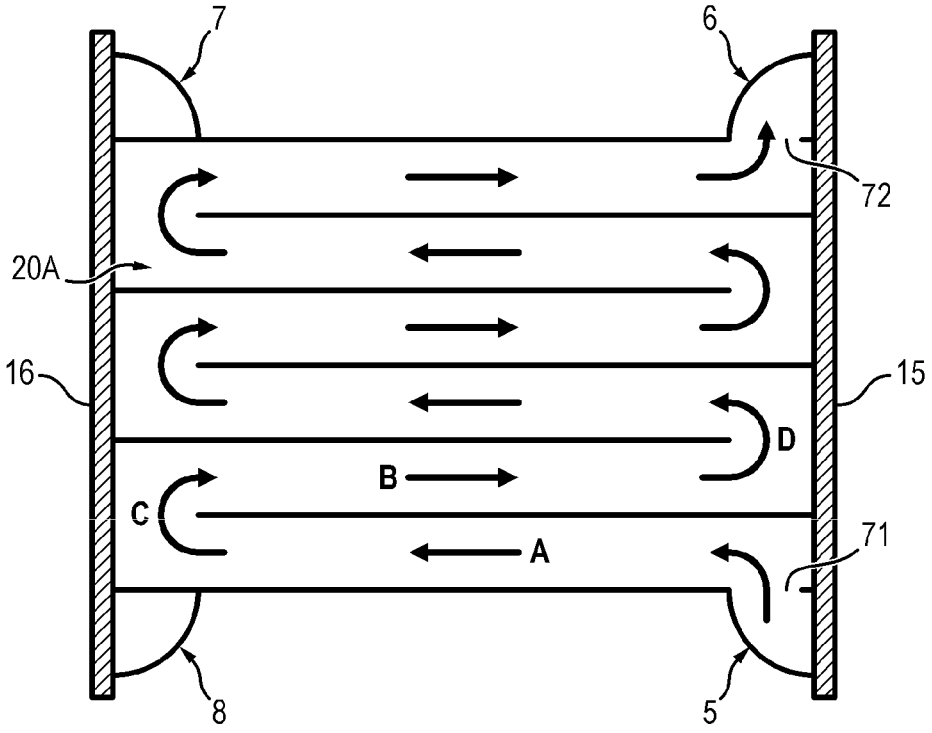
Figure 10:
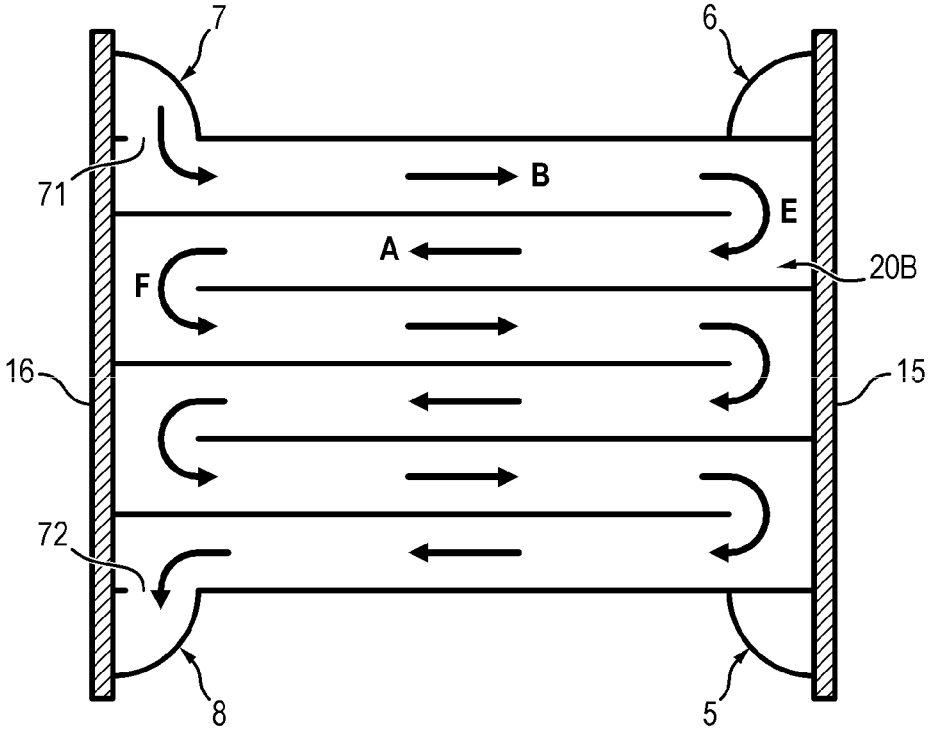
Figure 12:
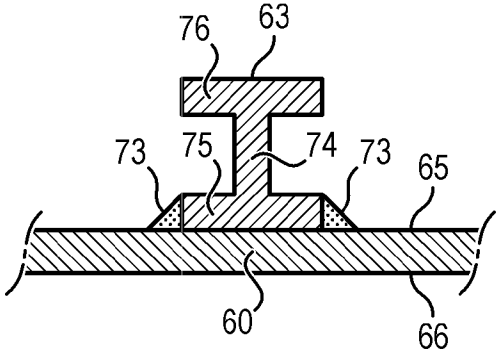
Figure 15:
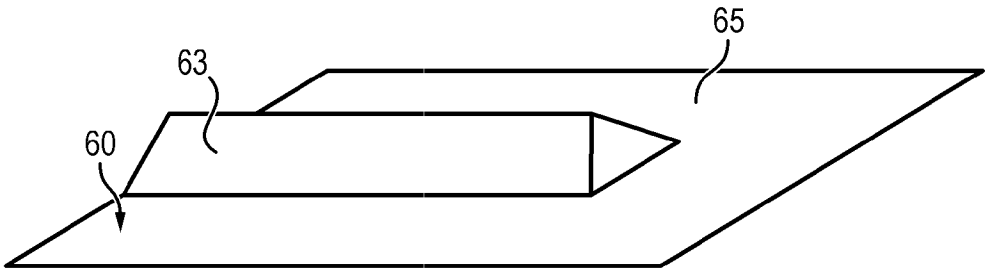
Figure 11:
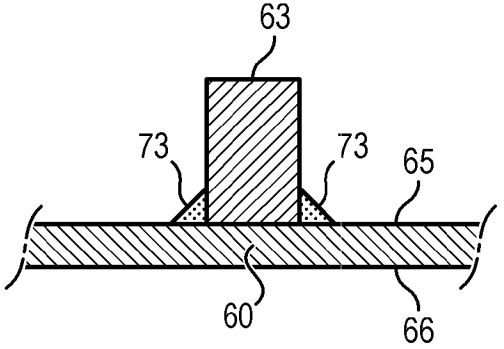
Figure 14:
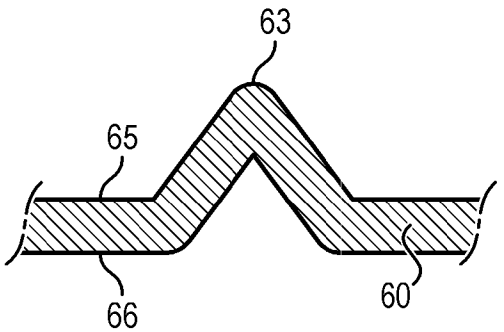
Figure 16:
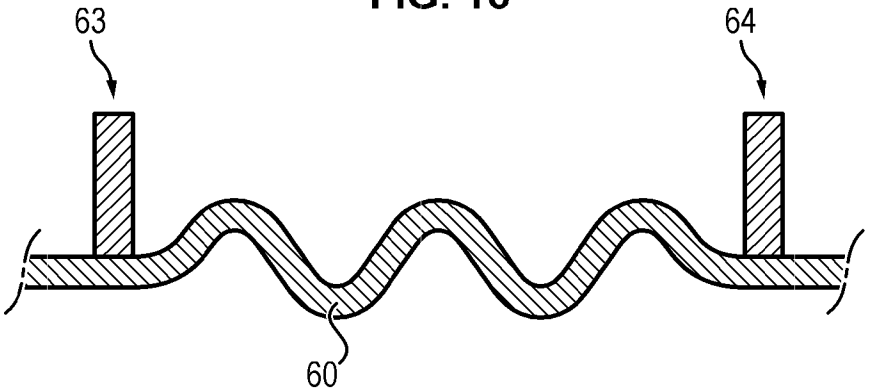
Figure 17:
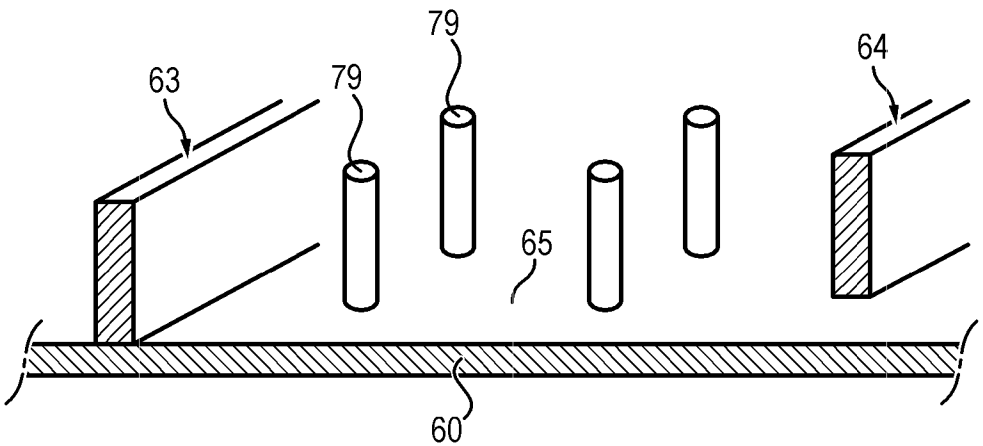
Figure 13:
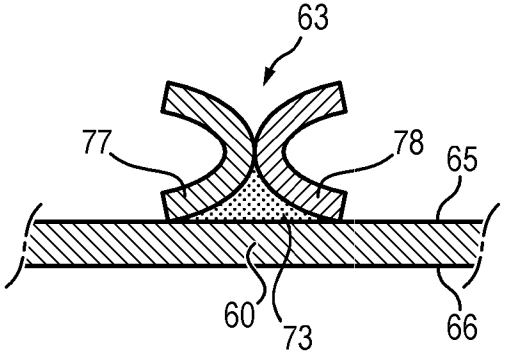
Figure 18:
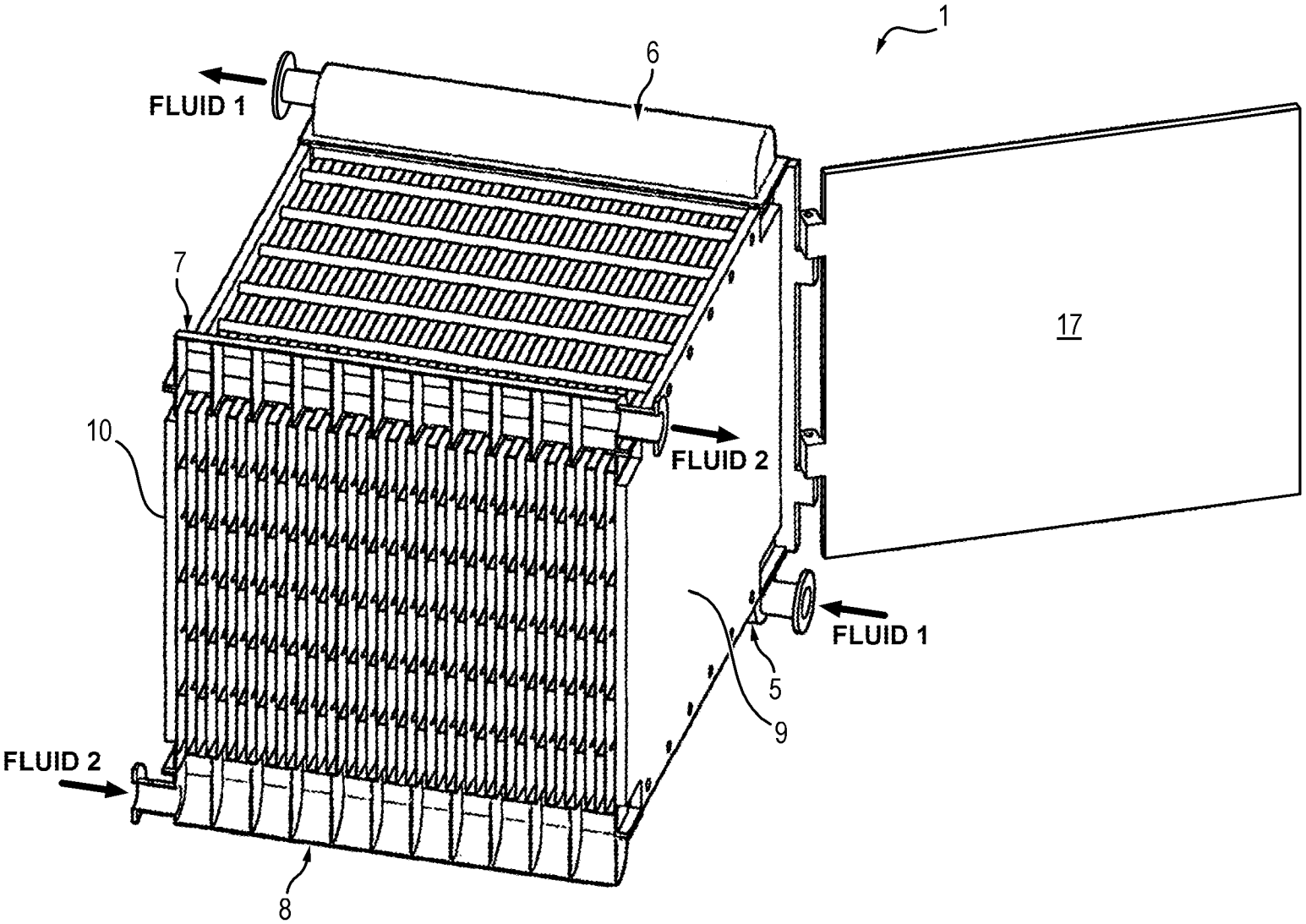

Other features and advantages will also be revealed by the description that follows, which is purely illustrative and not limiting, and must be read with reference to the appended drawings, among which:

FIG. 1 shows schematically, in perspective, a heat exchanger conforming to one embodiment of the invention, FIG. 2 shows the heat exchanger schematically, in front view, FIG. 3 shows the heat exchanger schematically in side view, FIG. 4 shows the heat exchanger schematically, in top view, FIG. 5 is a section view, in the transverse section plane A-A, of the heat exchanger, FIG. 6 is a section view, in the longitudinal section plane B-B, of the heat exchanger, FIG. 7 is an exploded view of the heat exchanger of FIGS. 1 to 6, FIGS. 8A and 8B show schematically exchanger plates intended to be stacked with other identical plates in the heat exchanger, FIG. 9 show schematically a first circulation path of a first fluid in the heat exchanger, FIG. 10 shows schematically a second circulation path of a second fluid in the heat exchanger, FIG. 11 shows schematically a longitudinal rib conforming to a first embodiment of the invention, FIG. 12 shows schematically a longitudinal rib conforming to a second embodiment of the invention, FIG. 13 shows schematically a longitudinal rib conforming to a fourth embodiment of the invention, FIGS. 14 and 15 show schematically a longitudinal rib conforming to a third embodiment of the invention, FIG. 16 shows schematically an example of a main panel which has ridges, FIG. 17 shows schematically an example of a main panel provided with studs, FIG. 18 shows the heat exchanger schematically, the doors of which are in the open position.

DETAILED DESCRIPTION OF AN EMBODIMENT

In FIGS. 1 to 7, the heat exchanger 1 shown comprises two support legs 2 and 3, a pack of exchanger plates 4, four fluid collectors 5 to 8, two compression plates 9 and 10, two series of tie rods 11 and 12, two support frames 13 and 14, two gaskets 15 and 16 and two lateral doors 17 and 18.

The pack of exchanger plates 4 comprise a plurality of exchanger plates 20 stacked on one another and welded together.

In the example illustrated in FIGS. 1 to 7, the plates 20 of the stack are identical to one another, with the exception of an end plate 21.

When the exchanger plates 20 are stacked, the plate pack 4 has a front face 22, a back face 23 opposite to the front face 22, a first lateral face 24, a second lateral face 25, opposite to the front face 24, an upper face 26 and a lower face 27, opposite to the upper face 26.

The exchanger plates 20 of the plate pack 4 delimit fluid circulation channels between them. More precisely, the exchanger plates delimit between them two distinct circulation channels in which respectively a first fluid and a second fluid can circulate without mixing.

The two compression plates 9 and 10 include a first compression plate 9 and a second compression plate 10. The plate pack 4 is disposed between the two compression plates 9 and 10. The exchanger plates 20 of the plate pack 4 are held in compression against one another by the compression plates 9 and 10. More precisely, the first compression plate 9 is disposed against the front face 22 of the plate pack 4 and the second compression plate 10 is disposed against the back face 23 of the plate pack 4. A first series of tie rods 11 extends along the upper face 26 and a second series of tie rods 12 extends along the lower face 27. The tie rods 11 and 12 connect together the first compression plate 9 and the second compression plate 10, so as to oppose the dilation forces which can be generated by the fluids circulation between the exchanger plates 20 and 21 of the plate pack 4. Each of the ends of the tie rods is attached to one of the compression plates and the tie rods 11, 12 can be held in tension by means of clamping nuts. In this manner, the compression plates 9 and 10 exert on the plate pack a constant compression force tending to hold the exchanger plates 20, 21 supported against one another and to oppose their separation.

Each support leg 2, 3 is able to support the compression plates 9, 10, to hold the heat exchanger 1 above the ground.

The support frames 13, 14 include a first support frame 13 and a second support frame 14. Each of the first support frame 13 and of the fourth support frame 14 is attached to the plate pack 4 or to the compression plates 9, 10, by welding for example. The first support frame 13 is able to surround the assembly formed from the plate pack 4 and from the two compression plates 9, 10. The first support frame 13 extends around the first lateral face 24 off the plate pack 4. The second support frame 14 is able to surround the assembly formed from the plate pack 4 and the two compression plates. The second support frame 14 extends around the second lateral face 25 of the plate pack 4.

The lateral doors 17, 18 include a first door 17 mounted in rotation on the first support frame 13 and a second door 18 mounted in rotation on the second support frame 14. The first door 17 can be mounted in rotation on the first support frame 13 by means of first hinges 31. The first door 17 is movable between a closed position, in which the first door 17 covers the first lateral face 24 of the plate stack 4 and masks it, and an open position, in which the first door 17 does not cover the first lateral face 24 of the plate stack 4 and allows access to it.

Likewise, the second door 18 can be mounted in rotation on the second frame 14 by means of second hinges 32. The second door 18 is movable between a closed position, in which the second door 18 covers the second lateral face 25 of the plate stack 4 and masks it, and an open position in which the second door 18 does not cover the second lateral face 25 of the plate stack 4 and allows access to it.

The first door 17 can be locked in the closed position, by means of screws 33, the screws 33 serving to screw the first door 17 to the first frame 13. Likewise, the second door 18 can be locked in the closed position, by means of screws 34, the screws 34 serving to screw the second door 18 to the second frame 14.

The gaskets 15 and 16 include a first gasket 15 able to be disposed between the first door 17 and the first lateral face 24 of the stack 4 and a second gasket 16 able to be disposed between the second door 18 and the second lateral face 25 of the stack 4. Each gasket 15, 16 can be formed from a sheet of polymer material. The polymer material can be an elastomer, for example a nitrile (acetonitrile-butadiene) rubber, an EPDM (ethylene propylene diene monomer) rubber or a fluorocarbon rubber. The gaskets 15, 16 ensure peripheral sealing of each exchanger plate 20 and prevent flow of the fluids from one fluid circulation channel to the other.

The collectors 5 to 8 include a first inlet collector 5, a first outlet collector 6, a second inlet collector 7 and a second outlet collector 8.

The first inlet collector 5 and the first outlet collector 6 are able to guide a first fluid (for example a cold fluid) so that the first fluid circulates inside the plate pack 4 in a first fluid circulation channel.

Likewise, the second inlet collector 7 and the second outlet collector 8 are able to guide a second fluid (for example a hot fluid) so that the second fluid circulates inside the plat pack 4 in a second fluid circulation channel, distinct from the first fluid circulation channel.

In the example illustrated in FIGS. 1 to 7, the first inlet collector 5 is attached to the lower face 27 of the plate pack 4 and the first outlet collector 6 is attached to the upper face 26 of the plate pack 4. The second inlet collector 7 is attached to the upper face 26 of the plate pack 4 and the second outlet collector 8 is attached to the lower face 27 of the plate pack 4.

The first inlet collector 5 comprises a first inlet manifold 35 able to be connected to a first feed line of the first fluid and a first inlet collector wall 45, having for example a general shape of a quarter of a cylinder of revolution, and a series of internal partitions 55 extending transversely to the axis of the cylinder.

The first outlet collector 6 comprises a first extraction manifold of the first fluid 36, able to be connected to a first extraction line of the first fluid, a first outlet collector wall 46 having for example the general shape of a quarter of a cylinder of revolution, and a series of internal partitions 56 extending transversely to the axis of the cylinder.

Each internal partition 55 of the first inlet collector 5 and each internal partition 56 of the first outlet collector 6 has a free edge extending in the same plane as the lateral face 24. Each free edge is in contact with the first gasket 16. In this manner, the internal partitions 55, 56 define with the first gasket 15 compartments allowing the first fluid flowing in a space between two exchanger plates 20 to be guided toward another space between two other exchanger plates.

Likewise, the second inlet collector 7 comprises a second inlet manifold 37 able to be connected to a second feed line of the second fluid, a second wall of the inlet collector 47, having for example the general shape of a quarter of a cylinder of revolution, and a series of internal partitions 57 extending transversely to the axis of the cylinder.

The second outlet collector 8 comprises a second outlet manifold 38 able to be connected to a second extraction duct of the second fluid, a second outlet collector wall 48, having for example the general shape of a quarter of a cylinder of revolution, and a series on internal partitions 58 extending transversely to the axis of the cylinder.

Each internal partition 57 of the second inlet collector 7 and each internal partition 58 of the second outlet collector 8 has a free edge extending in the same plane as the lateral face 24. Each free edge is in contact with the second gasket 16. In this manner, the internal partitions 57, 58 define, with the second gasket 16, compartments allowing guiding the second fluid flowing in a space between two exchanger plates 20 toward another space between two other exchanger plates.

The exchanger plates 20 include the first exchanger plates 20A and the second exchanger plates 20B illustrated schematically in FIGS. 8A and 8B.

FIG. 8A shows schematically a first exchanger plate 20A intended to guide the first fluid.

The first exchanger plate 20A can be formed of metal, for example of titanium or stainless steel, such as a stainless steel containing chromium and molybdenum which increase resistance to corrosion, of nickel or of an alloy containing nickel and copper. The selection of the material of the plate 20A depends on the nature of the fluids to be processed and on their condition (temperature, pressure).

The first exchanger plate 20A comprises a main panel 60, two junction panels 61, 62 and ribs 63, 64 protruding from the main panel 60 and delimiting a circulation path for the fluid.

The main panel 60 has the general shape of a rectangle. The main panel 60 comprises a first face 65 and a second face 66, opposite to the first face 65. The first face 65 and/or the second face 66 of the main panel 60 can be smooth, or have ridges favoring the generation of turbulence in the fluid. The main panel 60 can, for example, be formed from landed or corrugated sheet.

The main panel 60 has four edges 67 to 70. The main panel 60 has a first edge 67, a second edge 68 opposite to the first transverse edge 67, a third edge 69 and a fourth edge 70 opposite to the third edge 69.

In the example illustrated in FIG. 8A, the first edge 67 and the second edge 68 are transverse edges, while the third edge 69 and the fourth edge 70 are longitudinal edges.

The first edge 67 and the second edge 68 are parallel to one another. The third edge 69 and the fourth edge 70 are parallel to one another, and are perpendicular to the edges 67 and 68.

The junction panels 61, 62 include a first junction panel 61 extending from the third longitudinal edge 69 of the main panel 60 and a second junction panel 62 extending from the fourth longitudinal edge 70 of the main panel 60. The first junction panel 61 and the second junction panel 62 can be connected to the main panel 60 respectively by a first fold line and by a second fold line.

The first junction panel 61 has a first opening 71, (or fluid inlet opening formed in the first junction panel 61) allowing entry of the fluid toward the circulation path. The second junction panel 62 has a second opening 72 (or fluid exit opening formed in the second junction panel 62) allowing the fluid originating in the circulation path to exit.

The exchanger plate 20A does not comprise junction panels extending from the transverse edges 67 and 68 of the main panel. Thus, the edges 67 and 68 of the main panel 60 are free.

The ribs 63, 64 protrude from the first face 65 of the main panel 60. The ribs 63, 64 constitute spacers allowing spacing to be maintained between two main panels 60 of two adjacent exchanger plates 20A and 20B and resisting the compression forces which can be exerted on the plate pack 4. To this end, each rib 63, 64 is dimensioned to be in contact with a second face 66 of a main panel 60 of an adjacent exchanger plate 20B in the stack.

All the ribs 63, 64 extend parallel to one another. In the example illustrated in FIG. 8, the ribs 63, 64 extend parallel to the longitudinal edges 69, 70 of the main panel 60. The first plate 20A does not comprise ribs extending parallel to the transverse edges 67, 68.

In the example illustrated in FIG. 20A, the ribs 63, 64 include a plurality of first ribs 63 and a plurality of second ribs 64, the second ribs 64 being disposed alternately with the first ribs.

Each first rib 63 extends from the first transverse edge 67 of the main panel 60 toward the second transverse edge 68, without however extending until the second transverse edge 68. Each first rib 63 thus provides a first fluid passage between one end of the first rib 63 and the second transverse edge 68. At this location, the fluid circulation path forms a first baffle.

Each second rib 64 extends from the second transverse edge 68 of the main panel 60 toward the first transverse edge 67, without however extending until the first transverse edge 67. Each second rib 64 thus provides a second fluid passage between one end of the second rib 64 and the first transverse edge 67. At this location, the fluid circulation path forms a second baffle.

The first exchanger plate comprises n+1 first ribs (n being an integer greater than or equal to 0, preferably greater than or equal to 1) and n second ribs. In the example illustrated in FIG. 8, the exchanger plate comprises 3 first ribs 63 (n=2) and 2 second ribs 64, each second rib 64 being interspersed between two first ribs 63.

The first opening 71 and the second opening 72 are arranged in proximity to the first transverse edge 67. The second opening 72 is disposed facing the first opening 71. The two openings 71, 72 are aligned with one another along the first transverse edge 67.

In the embodiment just described, the first edge 67 and the second edge 68 are transverse edges, while the third edge 69 and the fourth edge 70 are longitudinal edges.

Alternatively, it would also be possible to create and exchanger plate in which the first edge 67 and the second edge 68 are longitudinal edges, while the third edge 69 and the fourth edge 70 are transverse edges.

FIG. 8B shows schematically a second exchanger plate 20B intended to guide a second fluid. In the plate pack 4, the second exchanger plate 20B is stacked with the first exchanger plate 20A of FIG. 8A. The second exchanger plate 20B constitutes an exchanger plate adjacent to the first exchanger plate 20A in the stack 4.

In the example illustrated in FIGS. 8A and 8B, the second exchanger plate 20B is identical to the first exchanger plate 20A. However, in the stack 4, the second exchanger plate 20B is oriented by being turned 180° relative to the first exchanger plate 20A, in the plane of its main panel 60.

The plate pack 4 is obtained by stacking a series of plates including a plurality of first plates 20A and a plurality of second plates 20B, disposed alternately with the first plates 20A.

In the stack, the first transverse edges 67 of the first plates 20A are disposed in register with the second transverse edges 68 of the second plates 20B. The first transverse edges 67 of the first plates 20A and the second transverse edges 68 of the second plates 20B thus define the first lateral face 24 of the plate pack 4.

Likewise, the second transverse edges 68 of the first plates 20A are disposed in register with the first transverse edges 67 of the second plates 20B. The second transverse edges 68 of the first plates 20A and the first transverse edges 67 of the second plates 20B thus define the second lateral face 25 of the plate pack 4.

In the stack, the third longitudinal edges 69 of the first plates 20A are disposed in register with the fourth longitudinal edges 70 of the second plates 20B. The third longitudinal edges 69 of the first plates 20A and the fourth longitudinal edges 70 of the second plates 20B thus define the lower face 27 of the plate pack 4.

Likewise, the fourth longitudinal edges 70 of the first plates 20A are disposed in register with the third longitudinal edges 69 of the second plates 20B. The fourth longitudinal edges 70 of the first plates 20A and the third longitudinal edges 69 of the second plates 20B thus define the upper face 26 of the plate pack 4.

FIG. 9 illustrates a first circulation path of the first fluid in the exchanger 1. The first fluid circulates between the first face 65 of a first exchanger plate 20A and the second face 66 of a second exchanger plate 20B.

The first fluid is injected into the first fluid circulation path via the first inlet collector 5. The first fluid circulates from the first opening 71 until the second opening 72 between the first ribs 63 and the second ribs 64 of the first exchanger plate 20A, bypassing the ends of the ribs 63, 64. More precisely, the first fluid circulates in alternation in a first orientation (arrow A), in a longitudinal direction of the main panel 60, then in a second orientation (arrow B), opposite to the first orientation, in the longitudinal direction. The first fluid circulation path has a succession of first baffles (arrow C) and of second baffles (arrow D), which allows lengthening the flow path of the first fluid along the first exchanger plate 20A while avoiding creating dead zones and thus favoring heat exchanges with the second fluid. The first fluid escapes via the second opening 72 toward the first outlet collector 6. The first outlet collator 6 guides the first fluid to again inject it between two exchanger plates 20A and 20B.

FIG. 10 illustrates a second fluid circulation path of the second fluid in the exchanger. The second fluid circulates between the first face 65 of a second exchanger plate 20B and the second face 66 of a first exchanger plate 20A. In the example illustrated in FIG. 10, the second fluid circulates in counter flow relative to the first fluid.

The second fluid is injected into the second fluid circulation path via the second inlet collector 7. The second fluid circulates from the first opening 71 until the second opening 72 between the first ribs 63 and the second ribs 64 of the second exchanger plate 20B, while bypassing the ends of the ribs 63, 64. More precisely, the second fluid circulates alternately in the second orientation (arrow B) in a longitudinal direction, then in the first orientation (arrow A), opposite to the second orientation, in the longitudinal direction. The second fluid circulation path has a succession of first baffles (arrow E) and of second baffles (arrow F), which allows lengthening the flow path of the second fluid along the exchanger plate 20B while avoiding creating dead zones and favoring heat exchange with the first fluid. The second fluid escapes via the second opening 72 toward the second outlet collector 8. The second outlet collector 8 guides the second fluid to inject it again between two exchanger plates 20B and 20A.

FIGS. 11 to 15 illustrate several examples of ribs 63 or 64.

According to a first example illustrated in FIG. 11, the rib 63 has a rectangular cross section. The rib 63 is attached to the main panel 60 via two weld lines 73 formed on either side of the rib. More precisely, the rib 63 is welded to the first face 65 of the main panel 60.

According to a second example illustrated in FIG. 12, the rib 63 has an I shaped cross section comprising a central core 74 and two webs 75, 76. The first web 75 is attached to the main panel 60 of the exchanger plate 20 by two weld lines 73. More precisely, the first web 75 is attached to the first face 65 of the main panel 60 of the exchanger plate 20 and the second web 76 is able to be attached to the second face 66 of a main panel 60 of an adjacent exchanger plate.

According to a third example illustrated in FIG. 13, the rib 63 has an x shaped cross section. The rib 63 is formed from two sections 77, 78 each having a C shaped cross section, the two sections being disposed symmetrically against one another. The rib 63 is attached to the main panel 60 via one weld line 73 formed between the first face 65 of the main panel 60 and the two C shaped sections. More precisely, the rib 63 is welded to the first face 65 of the main panel 60.

In the three preceding examples, the rib 63 is formed by a separate section applied to the main panel 60 of the exchanger plate 20.

According to a fourth example illustrated in FIGS. 14 and 15, the rib 63 is formed by stamping the exchanger plate 20. The main panel 60 and the ribs 63, 64 are thus formed in a single piece of material. The rib 63 is able to joined to the second face 66 of a main panel 60 of an adjacent exchanger plate, for example by a weld line extend along the top of the rib 63.

FIG. 16 shows schematically an example of a main panel 60 having ridges favoring the generation of turbulence in the fluid. In this example, the ridges comprise corrugations. The corrugations comprise recesses and bumps extending in a general direction parallel to the ribs 63 and 64.

FIG. 17 shows schematically an example in which the heat exchanger 1 comprises, in addition to longitudinal ribs 63 64, studs 79 protruding from the main panel 60 and forming additional spacers allowing the plate pack 4 to support compression forces.

In FIG. 18, the heat exchanger 1 is shown with the first door 17 and the second door 18, each in the open position.

As can be seen on this figure, once the doors 17 and 18 are opened, the heat exchanger 1 can easily be cleaned. In fact, the operator has direct access to spaces provided between the exchanger plates 20. As the ribs 63, 64 extend parallel to one another in a direction orthogonal to the lateral faces 24, 25, of the plate pack 4, it is possible to introduce a cleaning tool and/or to cause a jet of water under pressure to pass between the plates 20 from the lateral faces 24, 25 parallel to the ribs.

In addition, as can be seen in FIG. 18, the cleaning of the exchanger 1 can be carried out without disassembling the collectors 5 to 8.

In the embodiment that was just described, each of the first plates 20A and of the second plates 20B comprises longitudinal ribs 63, 64. However, it would also be possible to design a plate stack 4 in which only the first plates 20A comprise longitudinal ribs while the second plates 20B are devoid of ribs.

Alternatively, it would also be possible to accomplish a stack of plates 4, in which the first plates 20A comprise only longitudinal ribs and the second plates 20B comprise only transverse ribs, so that the two fluids flow in orthogonal directions inside the heat exchanger.

The invention claimed is:

1. A heat exchanger comprising:

a plate pack comprising a stack of plates welded together, each plate comprising:

a main panel having a first edge, a second edge, opposite to the first edge, a third edge, and a fourth edge, opposite to the third edge, at least one first rib protruding from the main panel and able to delimit, with the main panel and an adjacent plate, a fluid circulation path, and a first junction panel extending from the third edge, wherein the first rib extends from the first edge of the main panel toward the second edge, without extending until the second edge, so as to provide a first fluid passage between one end of the first rib and the second edge where the fluid circulation path forms a first baffle, and wherein the first junction panel has a fluid inlet opening allowing entry of the fluid to the circulation path, the plate pack comprising a first lateral face defined by the first and second edges of the plates of the stack, and a second lateral face defined by the first and second opposite edges of the plates of the stack, and a first door movable in rotation relative to the plate pack, between a closed position in which the first door covers the first lateral face of the stack, and an open position in which the first door does not cover the first lateral face of the stack and allows access to spaces defined between the plates.

2. The heat exchanger according to claim 1, further comprising a first fluid inlet collector and a first fluid outlet collector, each of the first collectors being attached to a face of the stack orthogonal to the lateral faces and defined by the third and fourth edges of the plates of the stack.

3. The heat exchanger according to claim 2, wherein each first collector comprises a first collector wall extending from the face of the stack orthogonal to the lateral faces until the first door, so that when the first door is in the open position, the first door allows access to an internal space of the first collector.

4. The heat exchanger according to claim 1, further comprising a first gasket able to be disposed against the first lateral face of the stack, in contact with each of the first and second edges forming the first lateral face.

5. The heat exchanger according to claim 1, further comprising a second door, movable in rotation relative to the plate pack, between a closed position in which the second door covers the second lateral face of the stack, and an open position in which the second door does not cover the second lateral face of the stack and allows access to spaces defined between the plates.

6. The heat exchanger according to claim 1, further comprising a second fluid inlet collector and a second fluid outlet collector, each of the second collectors being attached to a face of the stack orthogonal to the lateral faces and defined by third and fourth edges of the plates of the stack.

7. The heat exchanger according to claim 5, further comprising a second fluid inlet collector and a second fluid outlet collector, each of the second collectors being attached to a face of the stack orthogonal to the lateral faces and defined by third and fourth edges of the plates of the stack, wherein each second collector comprises a second collector wall extending from the face of the stack orthogonal to the lateral faces until the second door, so that when the second door is in the open position, the second door allows access to an internal space of the second collector.

8. The heat exchanger according to claim 1, comprising a second gasket able to be disposed against the second lateral face in contact with each of the first and second edges forming the second lateral face.

9. The heat exchanger according to claim 1, wherein at least one of the plates comprises at least one second rib protruding from the main panel and able to delimit with the main panel and an adjacent plate, the fluid circulation path, wherein the at least one second rib extends parallel to the at least one first rib from the second edge toward the first edge, without extending until the first edge, so as to provide a fluid passage between one end of the second rib and the first edge where the fluid circulation path forms a second baffle.

10. The heat exchanger according to claim 1, wherein at least one of the plates comprises a plurality of first ribs and a plurality of second ribs disposed alternately with the first ribs.

11. The heat exchanger according to claim 1, wherein at least one of the plates comprises a second junction panel extending from the fourth edge, the second junction panel having a fluid outlet opening allowing fluid originating in the circulation path to exit.

12. The heat exchanger according to claim 1, wherein at least one of the plates is devoid of a rib parallel to the first edge delimiting the fluid circulation path.

* * * * *